US006161707A

United States Patent [19]

Lin

[11] Patent Number: 6,161,707

[45] Date of Patent: Dec. 19, 2000

[54] HANGER RACK

[76] Inventor: Tsong-Yow Lin, 58, Ma Yaun West St., Taichung, Taiwan

[21] Appl. No.: 09/305,272

[22] Filed: May 3, 1999

[51] Int. Cl.[7] ..... A47F 5/08; A47F 7/00

[52] U.S. Cl. ..... 211/87.01; 211/87.01; 211/32

[58] Field of Search ..... 211/87.01, 30, 211/32, 6, 16, 88.04; D6/315, 563, 522, 346

[56] References Cited

U.S. PATENT DOCUMENTS

| | | | |
|---|---|---|---|
| 2,400,807 | 5/1946 | Buckhard | 211/87.01 |
| 2,805,777 | 9/1957 | Larson | 211/87.01 X |
| 2,889,050 | 6/1959 | Modrey | 211/4 |
| 3,938,667 | 2/1976 | Buckland | 211/87.01 |
| 5,727,698 | 3/1998 | Lai | 211/87.01 |
| 5,853,092 | 12/1998 | Goodman et al. | 211/87.01 X |

*Primary Examiner*—Alvin Chin-Shue
*Assistant Examiner*—Khoa Tran

[57] ABSTRACT

A hanger rack has a metal plate, a plastics plate, a plurality of male fasteners and female fasteners. The metal plate has a plurality of oblong holes, a plurality of through holes, and two flanges. A plurality of hanging hooks are formed on the plastics plate. A plurality of through apertures are formed on the plastics plate. Each of the hanging hooks has two positioning holes. Each of the hanging hooks is inserted through the respective oblong hole. Each of the male fasteners and each of the female fasteners fasten two of the hanging hooks together.

1 Claim, 6 Drawing Sheets

HANGER RACK

BACKGROUND OF THE INVENTION

The present invention relates to a hanger rack. More particularly, the present invention relates to a hanger rack which can be assembled easily.

A conventional hanger rack cannot be manufactured very fast. The cost of manufacturing a conventional hanger rack is relatively high.

SUMMARY OF THE INVENTION

An object of the present invention is to provide a hanger rack which can be assembled easily.

Another object of the present invention is to provide a hanger rack which has a metal plate and a plastics plate to occupy a small room and to occupy a small volume of a package material.

Accordingly, a hanger rack comprises a metal plate, a plastics plate, a plurality of male fasteners, and a plurality of female fasteners. A plurality of oblong holes are formed on the metal plate. A plurality of through holes are formed on the metal plate. Two flanges one is disposed on an upper portion and the other is disposed on a lower portion of the metal plate. A plurality of hanging hooks are formed on the plastics plate. A plurality of through apertures are formed on the plastics plate to match the through holes. Each of the hanging hooks has two positioning holes. Each of the hanging hooks is inserted through the respective oblong hole. Each of the male fasteners and each of the female fasteners fasten two of the hanging hooks together via insertion of the male fastener through respective ones of the positioning holes of a respective pair of hanging hooks and into engagment with the female fastener.

DETAILED DESCRIPTION OF THE INVENTION

Figure 1:
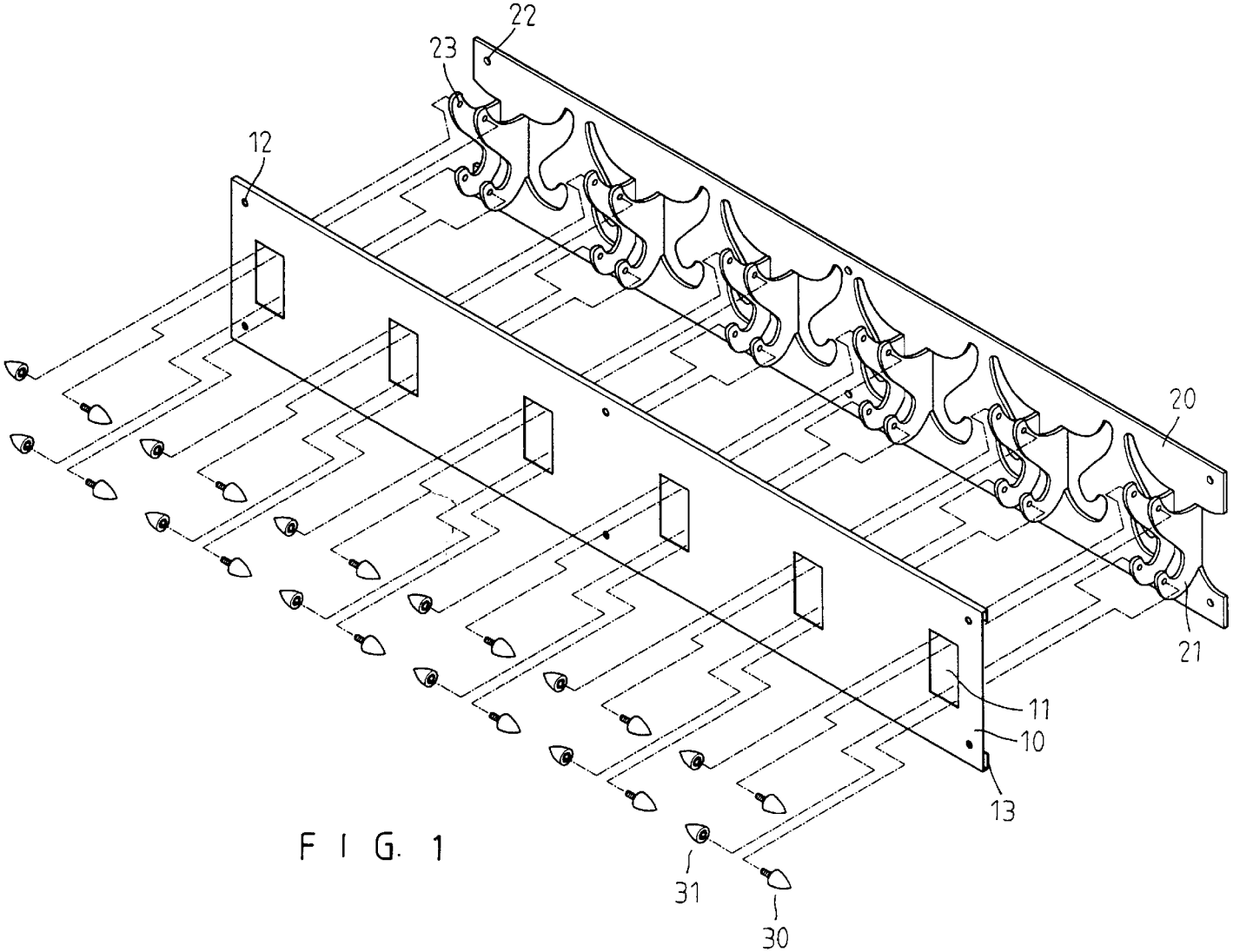
FIG. 1 is a perspective exploded view of a hanger rack of a preferred embodiment in accordance with the present invention.
Figure 2:
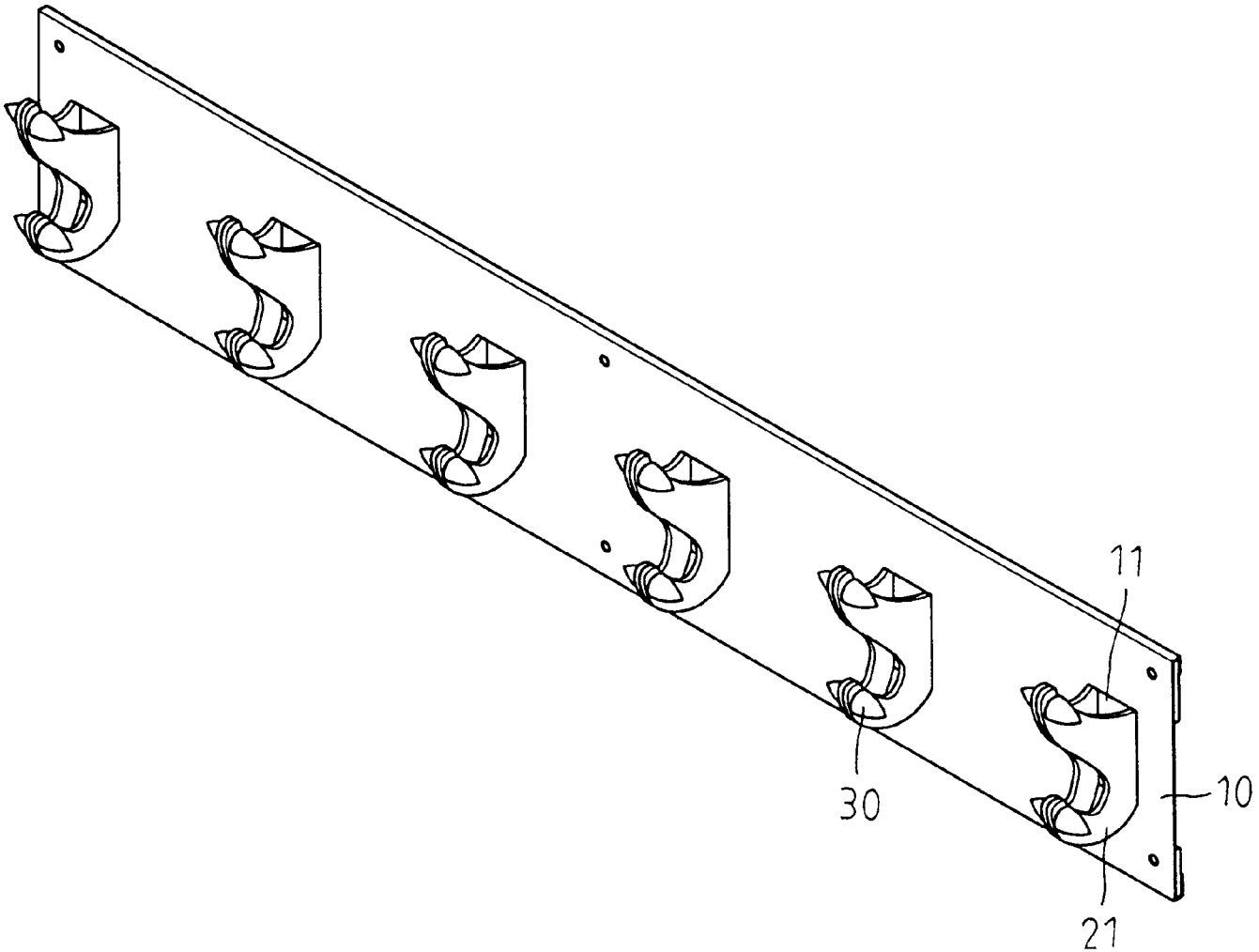
FIG. 2 is a perspective assembly view of a hanger rack of a preferred embodiment in accordance with the present invention.
Figure 3:
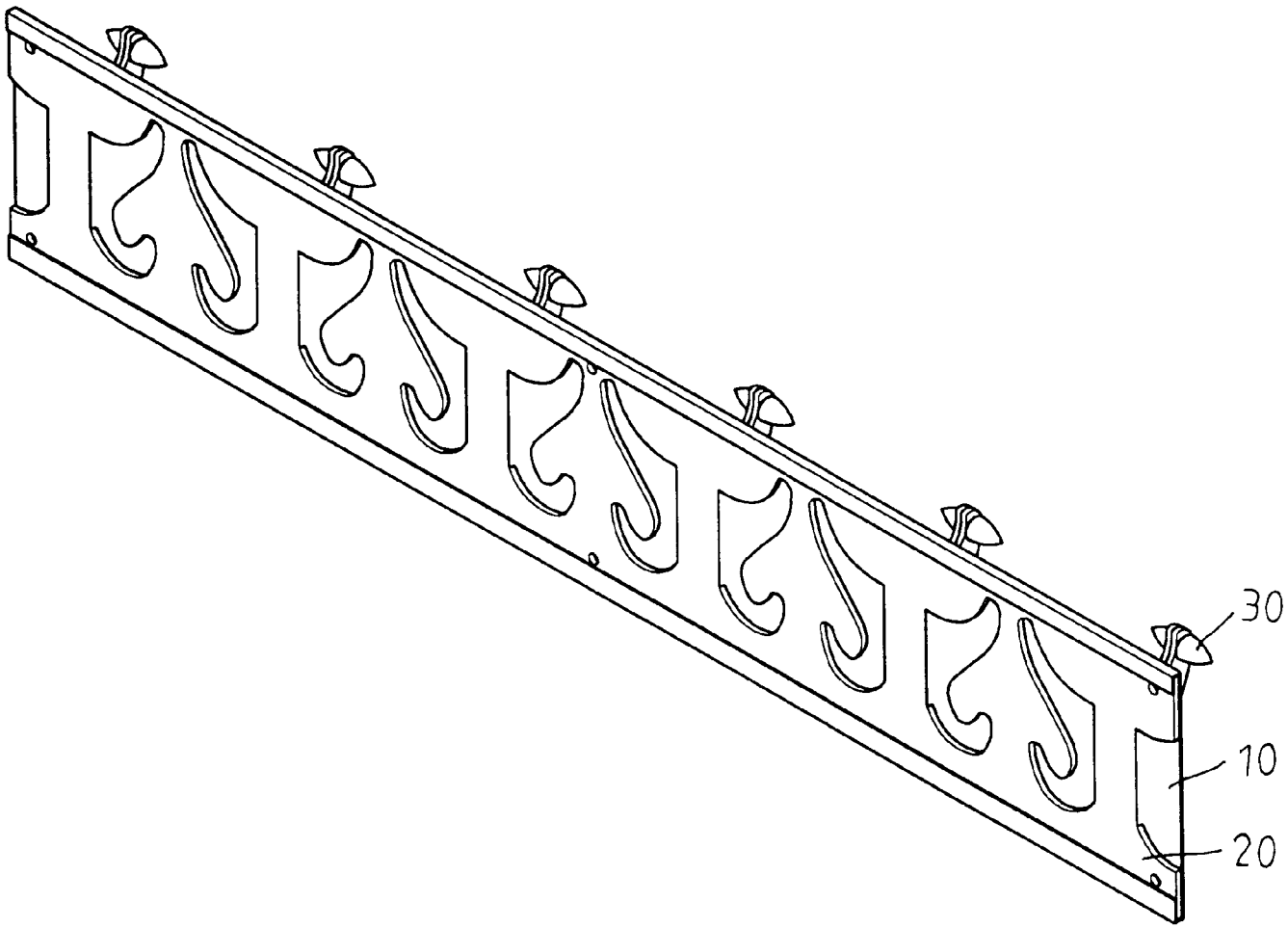
FIG. 3 is another perspective assembly view of a hanger rack of a preferred embodiment in accordance with the present invention.

Referring to FIGS. 1 to 3, a hanger rack comprises a metal plate 10, a plastics plate 20, a plurality of male fasteners 30, and a plurality of female fasteners 31. A plurality of oblong holes 11 are formed on the metal plate 10. A plurality of through holes 12 are formed on the metal plate 10. Two flanges 13 one is disposed on an upper portion and the other is disposed on a lower portion of the metal plate 10. A plurality of hanging hooks 21 are formed on the plastics plate 20. A plurality of through apertures 22 are formed on the plastics plate 20 to match the through holes 12.

Each of the hanging hooks 21 has two positioning holes 23.

Each of the hanging hooks 21 is inserted through the respective oblong hole 11.

Each of the male fasteners 30 and each of the female fasteners 31 fasten two of the hanging hooks 21 together via insertion of the male fastener 30 through respective ones of the positioning holes 23 of a respective pair of hanging hooks 21 and into engagement with the female fastener 31. The flanges 13 confine the plastics plate 20.

Figure 4:
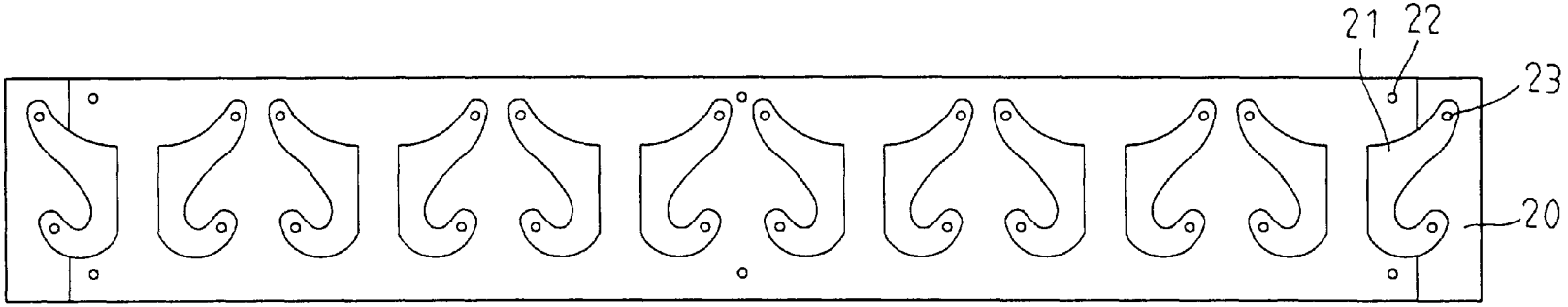
FIG. 4 is a schematic view of a plastics plate before a plurality of hanging hooks are made.

FIG. 4 is a schematic view showing a plastics plate 20 before a plurality of hanging hooks 21 are made.

Figure 5:
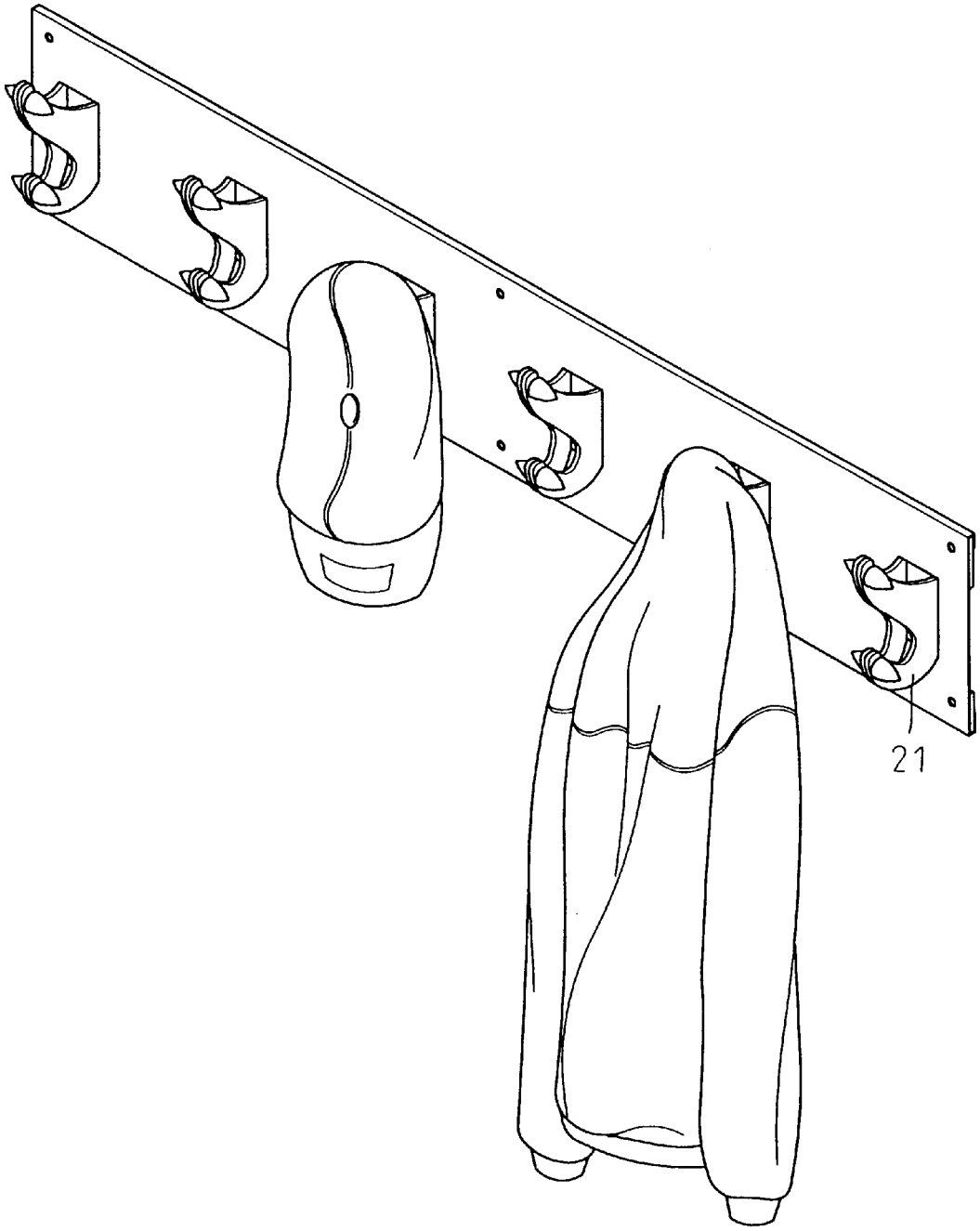
FIG. 5 is a schematic view illustrating an application of a hanger rack of a preferred embodiment in accordance with the present invention.

FIG. 5 is a schematic view illustrating an application of a hanger rack.

Figure 6:
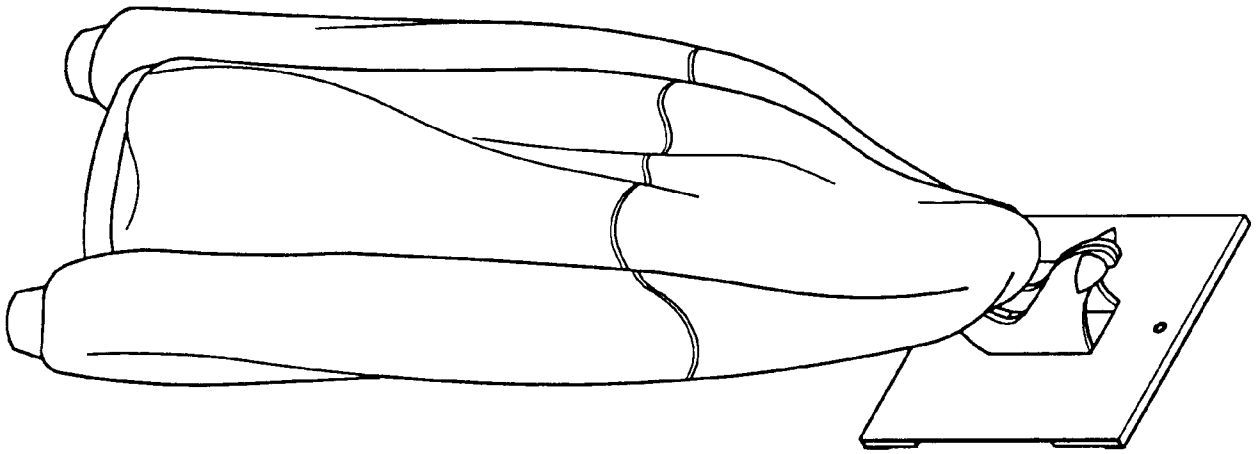
FIG. 6 is a perspective assembly view of a hanger rack which has two hanging hooks.

FIG. 6 is a perspective assembly view of a hanger rack which has two hanging hooks.

The invention is not limited to the above embodiment but various modification thereof may be made. Further, various changes in form and detail may be made without departing from the scope of the invention.

I claim:

1. A hanger rack comprises:

a metal plate, a plastics plate, a plurality of male fasteners, and a plurality of female fasteners, a plurality of oblong holes formed on the metal plate, a plurality of through holes formed on the metal plate, two flanges, one disposed on an upper portion and the other disposed on a lower portion of the metal plate, a plurality of pairs of hanging hooks formed on the plastics plate, a plurality of through apertures formed on the plastics plate to match the through holes on the metal plate, each said hanging hook having two positioning holes, each pair of said hanging hooks is inserted through a respective oblong hole on the metal plate, and each said male fastener and each said female fastener fastening two of the hanging hooks together via insertion of said male fastener through respective ones of said positioning holes of a respective pair of hanging hooks and into engagement with said female fastener.

* * * * *